US011242493B1

(12) United States Patent
Xu et al.

(10) Patent No.: US 11,242,493 B1
(45) Date of Patent: Feb. 8, 2022

(54) METHODS FOR PROCESSING CRUDE OILS TO FORM LIGHT OLEFINS

(71) Applicant: Saudi Arabian Oil Company, Dhahran (SA)

(72) Inventors: Qi Xu, Dhahran (SA); Aaron Akah, Dhahran (SA); Musead Salem Al-Ghrami, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/009,039

(22) Filed: Sep. 1, 2020

(51) Int. Cl.
*C10G 69/14* (2006.01)

(52) U.S. Cl.
CPC ..... *C10G 69/14* (2013.01); *C10G 2300/202* (2013.01); *C10G 2300/207* (2013.01); *C10G 2300/301* (2013.01)

(58) Field of Classification Search
CPC ..... C10G 69/14; C10G 2300/301; C10G 2300/207; C10G 2300/202
See application file for complete search history.

(56) References Cited

U.S. PATENT DOCUMENTS

| | | | |
|---|---|---|---|
| 977,228 | A | 11/1910 | Schestopol |
| 2,882,218 | A | 4/1959 | Jewell |
| 3,074,878 | A | 1/1963 | Pappas |
| 3,835,029 | A | 9/1974 | Larson |
| 3,837,822 | A | 9/1974 | Ward |
| 3,856,659 | A | 12/1974 | Owen |
| 3,888,762 | A | 6/1975 | Gerhold |
| 4,090,949 | A | 5/1978 | Owen et al. |
| 4,297,203 | A | 10/1981 | Ford et al. |
| 4,417,975 | A | 11/1983 | Myers |
| 4,419,221 | A | 12/1983 | Castagnos et al. |
| 4,436,613 | A | 3/1984 | Sayles et al. |
| 4,464,250 | A | 8/1984 | Myers et al. |
| 4,606,810 | A | 8/1986 | Krambeck et al. |
| 4,830,728 | A | 5/1989 | Herbst et al. |
| 4,980,053 | A | 12/1990 | Li et al. |
| 4,992,160 | A | 2/1991 | Long et al. |
| 5,026,935 | A | 6/1991 | Leyshon et al. |

(Continued)

FOREIGN PATENT DOCUMENTS

| | | | |
|---|---|---|---|
| CN | 1710029 | A | 12/2005 |
| CN | 102925210 | A | 2/2013 |

(Continued)

OTHER PUBLICATIONS

Corma, "A new continuous laboratory reactor for the study of catalytic cracking", Applied Catalysis A: General 232, pp. 247-263, 2002.

(Continued)

*Primary Examiner* — Randy Boyer
*Assistant Examiner* — Juan C Valencia
(74) *Attorney, Agent, or Firm* — Dinsmore & Shol LLP

(57) ABSTRACT

A hydrocarbon material may be processed by a method that includes separating the hydrocarbon material into at least a lesser boiling point fraction, a medium boiling point fraction, and a greater boiling point fraction. The method may further include steam cracking at least a portion of the lesser boiling point fraction, catalytically cracking at least a portion of the medium boiling point fraction, and hydrocracking at least a portion of the greater boiling point fraction.

19 Claims, 3 Drawing Sheets

(56) References Cited

U.S. PATENT DOCUMENTS

| | | | |
|---|---|---|---|
| 5,026,936 | A | 6/1991 | Leyshon et al. |
| 5,043,522 | A | 8/1991 | Leyshon et al. |
| 5,154,818 | A | 10/1992 | Harandi et al. |
| 5,158,919 | A | 10/1992 | Haddad et al. |
| 5,160,424 | A | 11/1992 | Le et al. |
| 5,171,921 | A | 12/1992 | Gaffney et al. |
| 5,232,580 | A | 8/1993 | Le et al. |
| 5,232,675 | A | 8/1993 | Shu et al. |
| 5,318,689 | A | 6/1994 | Hsing et al. |
| 5,326,465 | A | 7/1994 | Yongqing et al. |
| 5,334,554 | A | 8/1994 | Lin et al. |
| 5,372,704 | A | 12/1994 | Harandi et al. |
| 5,380,690 | A | 1/1995 | Zhicheng et al. |
| 5,451,313 | A | 9/1995 | Wegerer et al. |
| 5,462,652 | A | 10/1995 | Wegerer |
| 5,523,502 | A | 6/1996 | Rubin |
| 5,549,813 | A | 8/1996 | Dai et al. |
| 5,589,139 | A | 12/1996 | Zinke et al. |
| 5,597,537 | A | 1/1997 | Wegerer et al. |
| 5,637,207 | A | 6/1997 | Hsing et al. |
| 5,670,037 | A | 9/1997 | Zaiting et al. |
| 5,685,972 | A | 11/1997 | Timken et al. |
| 5,730,859 | A | 3/1998 | Johnson et al. |
| 5,770,042 | A | 6/1998 | Galperin et al. |
| 5,858,207 | A | 1/1999 | Lomas |
| 5,904,837 | A | 5/1999 | Fujiyama |
| 5,951,850 | A | 9/1999 | Ino et al. |
| 5,976,356 | A | 11/1999 | Drake et al. |
| 5,993,642 | A | 11/1999 | Mohr et al. |
| 6,015,933 | A | 1/2000 | Abrevaya et al. |
| 6,069,287 | A | 5/2000 | Ladwig et al. |
| 6,210,562 | B1 | 4/2001 | Xie et al. |
| 6,287,522 | B1 | 9/2001 | Lomas |
| 6,288,298 | B1 | 9/2001 | Rodriguez et al. |
| 6,300,537 | B1 | 10/2001 | Strohmaier et al. |
| 6,315,890 | B1 | 11/2001 | Ladwig et al. |
| 6,420,621 | B2 | 7/2002 | Sha et al. |
| 6,455,750 | B1 | 9/2002 | Steffens et al. |
| 6,521,563 | B2 | 2/2003 | Strohmaier et al. |
| 6,548,725 | B2 | 4/2003 | Froment et al. |
| 6,566,293 | B1 | 5/2003 | Vogt et al. |
| 6,602,403 | B1 | 8/2003 | Steffens et al. |
| 6,652,737 | B2 | 11/2003 | Touvelle et al. |
| 6,656,345 | B1 | 12/2003 | Chen et al. |
| 6,656,346 | B2 | 12/2003 | Ino et al. |
| 6,784,329 | B2 | 8/2004 | O'Rear et al. |
| 6,867,341 | B1 | 3/2005 | Abrevaya et al. |
| 6,979,755 | B2 | 12/2005 | O'Rear et al. |
| 7,019,187 | B2 | 3/2006 | Powers |
| 7,029,571 | B1 | 4/2006 | Bhattacharyya et al. |
| 7,087,154 | B2 | 8/2006 | Pinho et al. |
| 7,087,155 | B1 | 8/2006 | Dath et al. |
| 7,128,827 | B2 | 10/2006 | Tallman et al. |
| 7,153,479 | B2 | 12/2006 | Peterson et al. |
| 7,169,293 | B2 | 1/2007 | Lomas et al. |
| 7,220,351 | B1 | 5/2007 | Pontier et al. |
| 7,261,807 | B2 | 8/2007 | Henry et al. |
| 7,270,739 | B2 | 9/2007 | Chen et al. |
| 7,312,370 | B2 | 12/2007 | Pittman et al. |
| 7,314,964 | B2 | 1/2008 | Abrevaya et al. |
| 7,326,332 | B2 | 2/2008 | Chen et al. |
| 7,374,660 | B2 | 5/2008 | Steffens et al. |
| 7,459,596 | B1 | 12/2008 | Abrevaya et al. |
| 7,479,218 | B2 | 1/2009 | Letzsch |
| 7,686,942 | B2 | 3/2010 | Xie et al. |
| 7,906,077 | B2 | 3/2011 | Sandacz |
| 7,935,654 | B2 | 5/2011 | Choi et al. |
| 8,137,533 | B2 | 3/2012 | Towler et al. |
| 8,247,631 | B2 | 8/2012 | Nicholas et al. |
| 8,614,160 | B2 | 12/2013 | Upson et al. |
| 8,864,979 | B2 | 10/2014 | Palmas |
| 8,933,286 | B2 | 1/2015 | Souza et al. |
| 9,096,806 | B2 | 8/2015 | Abba et al. |
| 9,101,854 | B2 | 8/2015 | Koseoglu et al. |
| 9,290,705 | B2 | 3/2016 | Bourane et al. |
| 9,783,749 | B2 | 10/2017 | Davydov |
| 9,816,037 | B2 | 11/2017 | Avais |
| 2001/0042700 | A1 | 11/2001 | Swan, III et al. |
| 2001/0056217 | A1 | 12/2001 | Froment et al. |
| 2002/0003103 | A1 | 1/2002 | Henry et al. |
| 2003/0220530 | A1 | 11/2003 | Boelt et al. |
| 2005/0070422 | A1 | 3/2005 | Chen et al. |
| 2005/0150817 | A1 | 7/2005 | Tallman et al. |
| 2006/0108260 | A1 | 5/2006 | Henry |
| 2008/0011644 | A1 | 1/2008 | Dean et al. |
| 2008/0011645 | A1 | 1/2008 | Dean |
| 2008/0035527 | A1 | 2/2008 | Eng et al. |
| 2008/0044611 | A1 | 2/2008 | Husemann et al. |
| 2009/0012339 | A1 | 1/2009 | Choi et al. |
| 2009/0112035 | A1 | 4/2009 | Choi et al. |
| 2009/0288990 | A1 | 11/2009 | Xie et al. |
| 2011/0139679 | A1 | 6/2011 | Bories et al. |
| 2012/0241359 | A1 | 9/2012 | Al-Thubaiti et al. |
| 2013/0001130 | A1 | 1/2013 | Mo |
| 2013/0056393 | A1 | 3/2013 | Subramani et al. |
| 2013/0172643 | A1 | 7/2013 | Pradeep et al. |
| 2013/0248420 | A1 | 9/2013 | Palmas |
| 2013/0248421 | A1 | 9/2013 | Abba et al. |
| 2014/0110308 | A1 | 4/2014 | Bourane et al. |
| 2014/0228205 | A1 | 8/2014 | Narayanaswamy et al. |
| 2015/0094511 | A1 | 4/2015 | Bastianti et al. |
| 2016/0333280 | A1 | 11/2016 | Subramani et al. |
| 2017/0130140 | A1* | 5/2017 | Bhanuprasad ..... C10G 11/182 |
| 2017/0190991 | A1* | 7/2017 | Sundberg ..... C10G 11/04 |
| 2018/0057758 | A1 | 3/2018 | Al-Ghamdi et al. |
| 2018/0079974 | A1 | 3/2018 | Kokayeff et al. |
| 2018/0142167 | A1* | 5/2018 | Al-Ghamdi ..... B01D 3/009 |
| 2018/0223193 | A1 | 8/2018 | Kukade et al. |
| 2018/0305623 | A1 | 10/2018 | Al-Ghrami et al. |
| 2018/0327677 | A1 | 11/2018 | Ding et al. |
| 2018/0346827 | A1 | 12/2018 | Al-Ghamdi et al. |
| 2019/0119586 | A1 | 4/2019 | Gong et al. |
| 2019/0225894 | A1 | 7/2019 | Bourane et al. |
| 2020/0255753 | A1 | 8/2020 | Al-Herz et al. |
| 2021/0047573 | A1 | 2/2021 | Bourane et al. |

FOREIGN PATENT DOCUMENTS

| | | | |
|---|---|---|---|
| EP | 315179 | A1 | 5/1989 |
| EP | 2688982 | A1 | 1/2014 |
| GB | 978576 | | 12/1964 |
| WO | 2010053482 | A1 | 5/2010 |
| WO | 2012128973 | A1 | 9/2012 |
| WO | 2016096502 | A1 | 6/2016 |
| WO | 2016096970 | A1 | 6/2016 |
| WO | 2019106921 | A1 | 6/2019 |

OTHER PUBLICATIONS

International Search Report and Written Opinion pertaining to International Application PCT/US2018/030858 dated May 3, 2018.

Corma et al., "Different process schemes for converting light straight run and fluid catalytic cracing naphthas in a FCC unit for maximum propylene production", Applied Catalyst A: General 265, pp. 195-206, 2004.

Verstraete et al., "Study of direct and indirect naphtha recycling to a resid FCC unit for maximum propylene production". Catalysis Today, 106, pp. 62-71, 2005.

International Search Report and Written Opinion dated Apr. 4, 2019 pertaining to International application No. PCT/US2019/013978 filed Jan. 17, 2019, 19 pgs.

Corma et al., "Steam catalytic cracking of naphtha over ZSM-5 zeolite for production of propene and ethene: Micro and mascroscopic implications of the presence of steam", Applied Catalysis A: General 417-418, pp. 220-235, 2012.

Examination Report pertaining to Application No. GC2018-35391 dated Nov. 27, 2019.

Office Action dated Nov. 15, 2019 pertaining to U.S. Appl. No. 16/244,181, filed Jan. 10, 2019, 41 pgs.

(56) References Cited

OTHER PUBLICATIONS

Office Action dated May 13, 2020 pertaining to U.S. Appl. No. 15/945,362, filed Apr. 4, 2018, 55 pgs.
Office Action dated May 26, 2020 pertaining to U.S. Appl. No. 16/244,181, filed Jan. 10, 2019, 22 pgs.
Notice of Allowance dated Aug. 19, 2020 pertaining to U.S. Appl. No. 15/945,362, filed Apr. 4, 2018, 9 pgs.
Notice of Allowance dated Sep. 4, 2020 pertaining to U.S. Appl. No. 16/244,181, filed Jan. 10, 2019, 15 pgs.
Office Action dated Mar. 16, 2021 pertaining to U.S. Appl. No. 17/009,073, filed Sep. 1, 2020, 27 pgs.
International Search Report and Written Opinion dated Jun. 16, 2021 pertaining to International application No. PCT/US2021/015030 filed Jan. 26, 2021, 15 pages.
International Search Report and Written Opinion dated May 3, 2021 pertaining to International application No. PCT/US2021/015012 filed Jan. 26, 2021, 12 pages.
International Search Report and Written Opinion dated May 3, 2021 pertaining to International application No. PCT/US2021/015007 filed Jan. 26, 2021, 15 pages.
International Search Report and Written Opinion dated May 3, 2021 pertaining to International application No. PCT/US2021/015010 filed Jan. 26, 2021, 13 pages.
International Search Report and Written Opinion dated May 10, 2021 pertaining to International application No. PCT/US2021/015013 filed Jan. 26, 2021, 14 pages.
International Search Report and Written Opinion dated May 10, 2021 pertaining to International application No. PCT/US2021/015035 filed Jan. 26, 2021, 15 pages.
International Search Report and Written Opinion dated May 10, 2021 pertaining to International application No. PCT/US2021/015019 filed Jan. 26, 2021, 15 pages.
Office Action dated Jun. 7, 2021 pertaining to U.S. Appl. No. 17/009,008, filed Sep. 1, 2020, 28 pages.
Office Action dated Jun. 8, 2021 pertaining to U.S. Appl. No. 17/009,048, filed Sep. 1, 2020, 28 pages.
Office Action dated May 26, 2021 pertaining to U.S. Appl. No. 17/009,012, filed Sep. 1, 2020, 37 pages.
Office Action dated Jul. 6, 2021 pertaining to U.S. Appl. No. 17/009,020, filed Sep. 1, 2020, 41 pages.
Office Action dated Jul. 2, 2021 pertaining to U.S. Appl. No. 17/009,073, filed Sep. 1, 2020, 18 pages.

* cited by examiner

METHODS FOR PROCESSING CRUDE OILS TO FORM LIGHT OLEFINS

TECHNICAL FIELD

Embodiments of the present disclosure generally relate to chemical processing and, more specifically, to process and systems processing hydrocarbon feedstocks.

BACKGROUND

Ethylene, propene, butene, butadiene, and aromatics compounds such as benzene, toluene and xylenes are basic intermediates for a large proportion of the petrochemical industry. They are usually obtained through the thermal cracking (or steam pyrolysis) of petroleum gases and distillates such as naphtha, kerosene or even gas oil. These compounds are also produced through a refinery fluidized catalytic cracking (FCC) process where classical heavy feedstocks such as gas oils or residues are converted. Typical FCC feedstocks range from hydrocracked bottoms to heavy feed fractions such as vacuum gas oil and atmospheric residue; however, these feedstocks are limited. The second most important source for propene production is currently refinery propene from FCC units. With the ever growing demand, FCC unit owners look increasingly to the petrochemicals market to boost their revenues by taking advantage of economic opportunities that arise in the propene market.

The worldwide increasing demand for light olefins remains a major challenge for many integrated refineries. In particular, the production of some valuable light olefins such as ethylene, propene, and butene has attracted increased attention as pure olefin streams are considered the building blocks for polymer synthesis. The production of light olefins depends on several process variables like the feed type, operating conditions, and the type of catalyst.

SUMMARY

Despite the options available for producing a greater yield of propene and other light olefins, intense research activity in this field is still being conducted. It is desirable to produce light olefins and/or BTX directly from a crude oil source. However, such methods are problematic since crude oils contain very heavy components which may interfere with, for example, steam or catalytic cracking procedure. The present disclosure is directed to methods to form light olefins and/or BTX from hydrocarbon sources by separating the feed hydrocarbon stream into at least three streams, which are separately processed. Lighter components of the feed may be steam cracked, a middle portion of the feed may be catalytically cracked, and heavy components of the feed may be hydroprocessed. The hydroprocessed products may then be recycled in the system. Such a system produces enhanced yields of light olefins and/or BTX as compared with some known systems.

According to one or more embodiments, a hydrocarbon material may be processed by a method comprising separating the hydrocarbon material into at least a lesser boiling point fraction, a medium boiling point fraction, and a greater boiling point fraction. The method may further include steam cracking at least a portion of the lesser boiling point fraction, catalytically cracking at least a portion of the medium boiling point fraction, and hydrocracking at least a portion of the greater boiling point fraction.

According to one or more additional embodiments, a hydrocarbon material may be processed by a method comprising separating the hydrocarbon material into at least a lesser boiling point fraction, a medium boiling point fraction, and a greater boiling point fraction, steam cracking at least a portion of the lesser boiling point fraction, catalytically cracking at least a portion of the medium boiling point fraction, and hydrocracking at least a portion of the greater boiling point fraction. The lesser boiling point fraction may have a final boiling point of from 280° C. to 320° C. The medium boiling point fraction may have an initial boiling point of from 280° C. to 320° C. and may have a final boiling point of from 520° C. to 560° C. The greater boiling point fraction may have an initial boiling point of from 520° C. to 560° C.

Additional features and advantages of the described embodiments will be set forth in the detailed description which follows, and in part will be readily apparent to those skilled in the art from that description or recognized by practicing the described embodiments, including the detailed description which follows, the claims, as well as the appended drawings.

BRIEF DESCRIPTION OF THE DRAWINGS

The following detailed description of specific embodiments of the present disclosure can be best understood when read in conjunction with the following drawings, where like structure is indicated with like reference numerals and in which.

Figure 1:
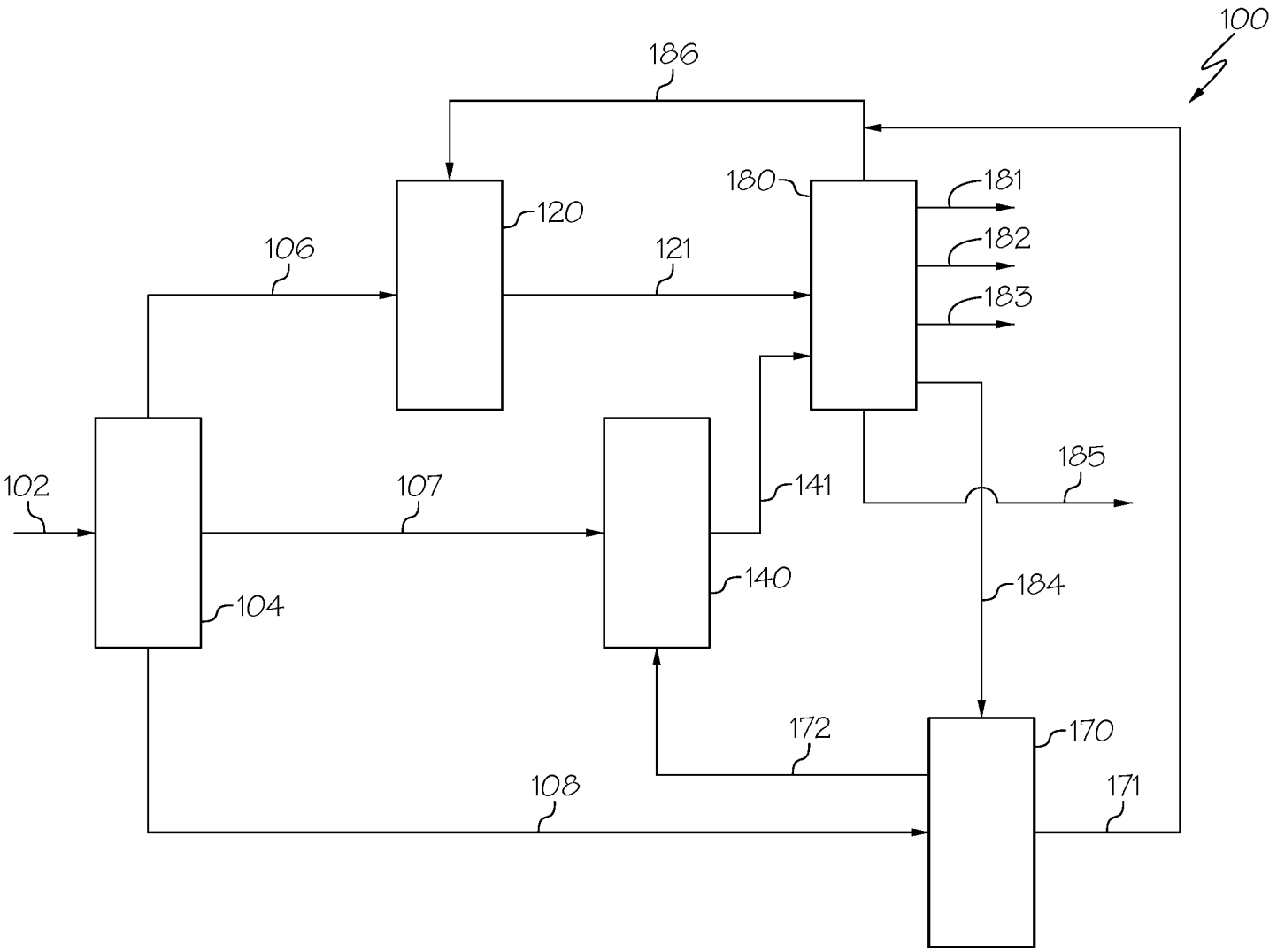
FIG. 1 is a generalized schematic diagram of a hydrocarbon conversion system, according to one or more embodiments described in this disclosure.

For the purpose of describing the simplified schematic illustrations and descriptions of the relevant figures, the numerous valves, temperature sensors, electronic controllers and the like that may be employed and well known to those of ordinary skill in the art of certain chemical processing operations are not included. Further, accompanying components that are often included in typical chemical processing operations, such as air supplies, catalyst hoppers, and flue gas handling systems, are not depicted. Accompanying components that are in hydrocracking units, such as bleed streams, spent catalyst discharge subsystems, and catalyst replacement sub-systems are also not shown. It should be understood that these components are within the spirit and scope of the present embodiments disclosed. However, operational components, such as those described in the present disclosure, may be added to the embodiments described in this disclosure.

It should further be noted that arrows in the drawings refer to process streams. However, the arrows may equivalently refer to transfer lines which may serve to transfer process streams between two or more system components. Additionally, arrows that connect to system components define inlets or outlets in each given system component. The arrow direction corresponds generally with the major direction of movement of the materials of the stream contained within the physical transfer line signified by the arrow. Furthermore, arrows which do not connect two or more system components signify a product stream which exits the depicted system or a system inlet stream which enters the depicted system. Product streams may be further processed in accompanying chemical processing systems or may be commercialized as end products. System inlet streams may be streams transferred from accompanying chemical processing systems or may be non-processed feedstock streams. Some arrows may represent recycle streams, which are effluent streams of system components that are recycled back into the system. However, it should be understood that any represented recycle stream, in some embodiments, may be replaced by a system inlet stream of the same material, and that a portion of a recycle stream may exit the system as a system product.

Additionally, arrows in the drawings may schematically depict process steps of transporting a stream from one system component to another system component. For example, an arrow from one system component pointing to another system component may represent "passing" a system component effluent to another system component, which may include the contents of a process stream "exiting" or being "removed" from one system component and "introducing" the contents of that product stream to another system component.

It should be understood that according to the embodiments presented in the relevant figures, an arrow between two system components may signify that the stream is not processed between the two system components. In other embodiments, the stream signified by the arrow may have substantially the same composition throughout its transport between the two system components. Additionally, it should be understood that in one or more embodiments, an arrow may represent that at least 75 wt. %, at least 90 wt. %, at least 95 wt. %, at least 99 wt. %, at least 99.9 wt. %, or even 100 wt. % of the stream is transported between the system components. As such, in some embodiments, less than all of the stream signified by an arrow may be transported between the system components, such as if a slip stream is present.

It should be understood that two or more process streams are "mixed" or "combined" when two or more lines intersect in the schematic flow diagrams of the relevant figures. Mixing or combining may also include mixing by directly introducing both streams into a like reactor, separation device, or other system component. For example, it should be understood that when two streams are depicted as being combined directly prior to entering a separation unit or reactor, that in some embodiments the streams could equivalently be introduced into the separation unit or reactor and be mixed in the reactor. Alternatively, when two streams are depicted to independently enter a system component, they may in some embodiments be mixed together before entering that system component.

Reference will now be made in greater detail to various embodiments, some embodiments of which are illustrated in the accompanying drawings. Whenever possible, the same reference numerals will be used throughout the drawings to refer to the same or similar parts.

DETAILED DESCRIPTION

One or more embodiments of the present disclosure are directed to systems and processes for converting one or more hydrocarbon feed streams into one or more petrochemical products. In general, a hydrocarbon feed stream may be separated into at least three streams of different compositions based on boiling point, referred to herein as the lesser boiling point fraction, the medium boiling point fraction, and the greater boiling point fraction. The lesser boiling point fraction may be steam cracked. The medium boiling point fraction may be catalytically cracked. The greater boiling point fraction may be hydrotreated.

As used in this disclosure, a "reactor" refers to a vessel in which one or more chemical reactions may occur between one or more reactants optionally in the presence of one or more catalysts. For example, a reactor may include a tank or tubular reactor configured to operate as a batch reactor, a continuous stirred-tank reactor (CSTR), or a plug flow reactor. Example reactors include packed bed reactors such as fixed bed reactors, and fluidized bed reactors. One or more "reaction zones" may be disposed in a reactor. As used in this disclosure, a "reaction zone" refers to an area where a particular reaction takes place in a reactor. For example, a packed bed reactor with multiple catalyst beds may have multiple reaction zones, where each reaction zone is defined by the area of each catalyst bed.

As used in this disclosure, a "separation unit" refers to any separation device that at least partially separates one or more chemicals that are mixed in a process stream from one another. For example, a separation unit may selectively separate differing chemical species, phases, or sized material from one another, forming one or more chemical fractions. Examples of separation units include, without limitation, distillation columns, flash drums, knock-out drums, knock-out pots, centrifuges, cyclones, filtration devices, traps, scrubbers, expansion devices, membranes, solvent extraction devices, and the like. It should be understood that separation processes described in this disclosure may not completely separate all of one chemical constituent from all of another chemical constituent. It should be understood that the separation processes described in this disclosure "at least partially" separate different chemical components from one another, and that even if not explicitly stated, it should be understood that separation may include only partial separation. As used in this disclosure, one or more chemical constituents may be "separated" from a process stream to form a new process stream. Generally, a process stream may enter a separation unit and be divided, or separated, into two or more process streams of desired composition. Further, in some separation processes, a "lesser boiling point fraction" (sometimes referred to as a "light fraction") and a "greater boiling point fraction" (sometimes referred to as a "heavy fraction") may exit the separation unit, where, on average, the contents of the lesser boiling point fraction stream have a lesser boiling point than the greater boiling point fraction stream. Other streams may fall between the lesser boiling point fraction and the greater boiling point fraction, such as a "medium boiling point fraction."

As used in this disclosure, the term "high-severity conditions" generally refers to FCC temperatures of 500° C. or greater, a weight ratio of catalyst to hydrocarbon (catalyst to oil ratio) of equal to or greater than 5:1, and a residence time of less than 3 seconds, all of which may be more severe than typical FCC reaction conditions.

It should be understood that an "effluent" generally refers to a stream that exits a system component such as a separation unit, a reactor, or reaction zone, following a particular reaction or separation, and generally has a different composition (at least proportionally) than the stream that entered the separation unit, reactor, or reaction zone.

As used in this disclosure, a "catalyst" refers to any substance that increases the rate of a specific chemical reaction. Catalysts described in this disclosure may be utilized to promote various reactions, such as, but not limited to, cracking (including aromatic cracking), demetalization, desulfurization, and denitrogenation. As used in this disclosure, "cracking" generally refers to a chemical reaction where carbon-carbon bonds are broken. For example, a molecule having carbon to carbon bonds is broken into more than one molecule by the breaking of one or more of the carbon to carbon bonds, or is converted from a compound which includes a cyclic moiety, such as a cycloalkane, cycloalkane, naphthalene, an aromatic or the like, to a compound which does not include a cyclic moiety or contains fewer cyclic moieties than prior to cracking.

As used in this disclosure, the term "first catalyst" refers to catalyst that is introduced to the first cracking reaction zone, such as the catalyst passed from the first catalyst mixing zone to the first cracking reaction zone. The first catalyst may include at least one of regenerated catalyst, spent first catalyst, spent second catalyst, fresh catalyst, or combinations of these. As used in this disclosure, the term "second catalyst" refers to catalyst that is introduced to the second cracking reaction zone, such as the catalyst passed from the second catalyst mixing zone to the second cracking reaction zone for example. The second catalyst may include at least one of regenerated catalyst, spent first catalyst, spent second catalyst, fresh catalyst, or combinations of these.

As used in this disclosure, the term "spent catalyst" refers to catalyst that has been introduced to and passed through a cracking reaction zone to crack a hydrocarbon material, such as the greater boiling point fraction or the lesser boiling point fraction for example, but has not been regenerated in the regenerator following introduction to the cracking reaction zone. The "spent catalyst" may have coke deposited on the catalyst and may include partially coked catalyst as well as fully coked catalysts. The amount of coke deposited on the "spent catalyst" may be greater than the amount of coke remaining on the regenerated catalyst following regeneration.

As used in this disclosure, the term "regenerated catalyst" refers to catalyst that has been introduced to a cracking reaction zone and then regenerated in a regenerator to heat the catalyst to a greater temperature, oxidize and remove at least a portion of the coke from the catalyst to restore at least a portion of the catalytic activity of the catalyst, or both. The "regenerated catalyst" may have less coke, a greater temperature, or both compared to spent catalyst and may have greater catalytic activity compared to spent catalyst. The "regenerated catalyst" may have more coke and lesser catalytic activity compared to fresh catalyst that has not passed through a cracking reaction zone and regenerator.

It should further be understood that streams may be named for the components of the stream, and the component for which the stream is named may be the major component of the stream (such as comprising from 50 weight percent (wt. %), from 70 wt. %, from 90 wt. %, from 95 wt. %, from 99 wt. %, from 99.5 wt. %, or even from 99.9 wt. % of the contents of the stream to 100 wt. % of the contents of the stream). It should also be understood that components of a stream are disclosed as passing from one system component to another when a stream comprising that component is disclosed as passing from that system component to another. For example, a disclosed "propylene stream" passing from a first system component to a second system component should be understood to equivalently disclose "propylene" passing from a first system component to a second system component, and the like.

Referring to FIG. 1, the hydrocarbon feed stream 102 may generally comprise a hydrocarbon material, and description of the hydrocarbon feed stream may be descriptive of embodiments of the hydrocarbon material. In embodiments, the hydrocarbon material of the hydrocarbon feed stream may be crude oil. As used in this disclosure, the term "crude oil" is to be understood to mean a mixture of petroleum liquids, gases, or combinations of liquids and gases, including some embodiments impurities such as sulfur-containing compounds, nitrogen-containing compounds and metal compounds that has not undergone significant separation or reaction processes. Crude oils are distinguished from fractions of crude oil. In certain embodiments the crude oil feedstock may be a minimally treated light crude oil to provide a crude oil feedstock having total metals (Ni+V) content of less than 5 parts per million by weight (ppmw) and Conradson carbon residue of less than 5 wt %. Such minimally treated materials may be considered crude oils as described herein.

Figure 2:
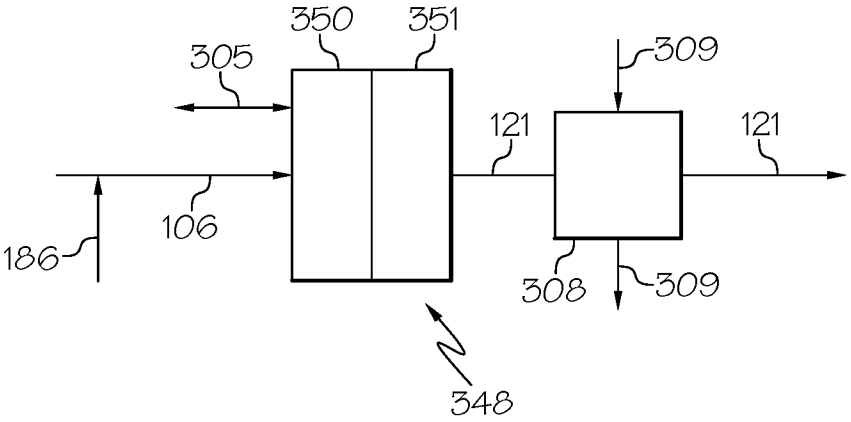
FIG. 2 depicts a generalized schematic diagram of a steam cracking unit, according to one or more embodiments described in this disclosure.
Figure 3:
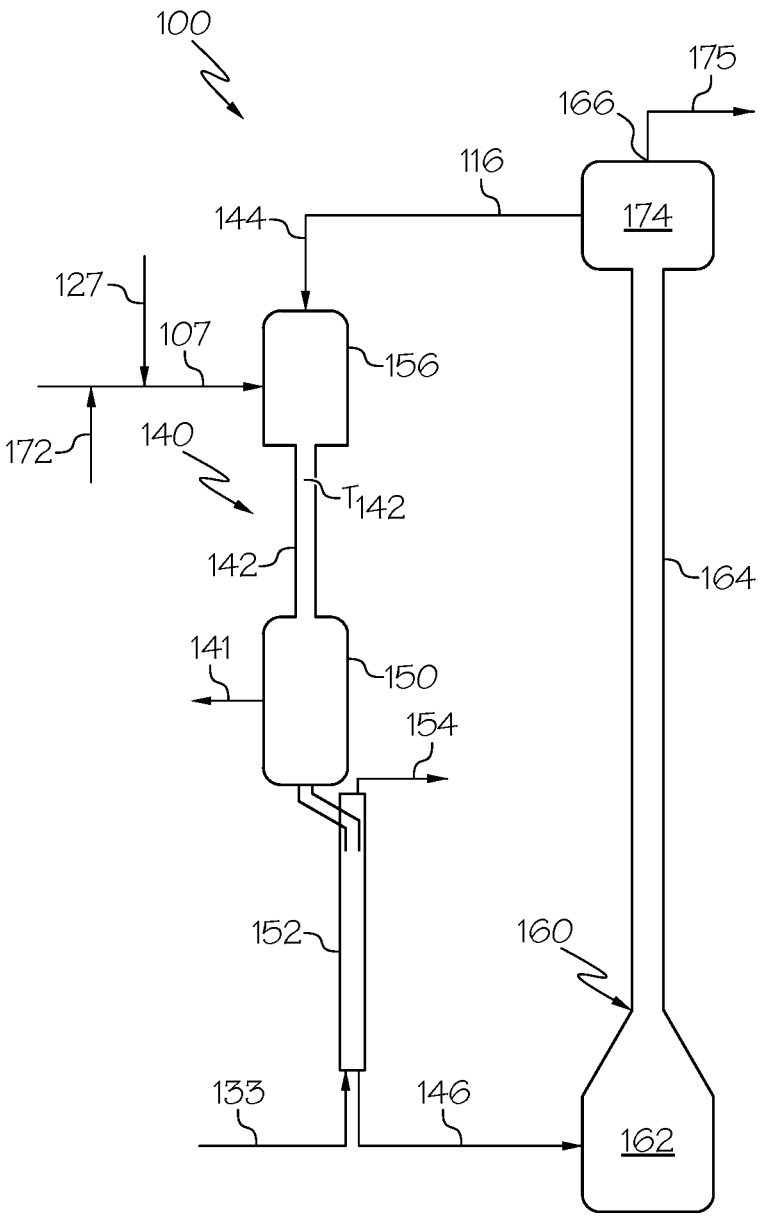
FIG. 3 depicts a generalized schematic diagram of a FCC unit, according to one or more embodiments described in this disclosure.

While the present description and examples may specify crude oil as the hydrocarbon material of the hydrocarbon feed stream 102, it should be understood that the hydrocarbon feed conversion systems 100 described with respect to the embodiments of FIGS. 1-3, respectively, may be applicable for the conversion of a wide variety of hydrocarbon materials, which may be present in the hydrocarbon feed stream 102, including, but not limited to, crude oil, vacuum residue, tar sands, bitumen, atmospheric residue, vacuum gas oils, demetalized oils, naphtha streams, other hydrocarbon streams, or combinations of these materials. The hydrocarbon feed stream 102 may include one or more non-hydrocarbon constituents, such as one or more heavy metals, sulphur compounds, nitrogen compounds, inorganic components, or other non-hydrocarbon compounds. If the hydrocarbon feed stream 102 is crude oil, it may have an American Petroleum Institute (API) gravity of from 22 degrees to 40 degrees. For example, the hydrocarbon feed stream 102 utilized may be an Arab heavy crude oil. (API gravity of approximately 28°), Arab medium (API gravity of approximately 30°), Arab light (API gravity of approximately 33°), or Arab extra light (API gravity of approximately 39°). Example properties for one particular grade of Arab heavy crude oil are provided subsequently in Table 1. It should be understood that, as used in this disclosure, a "hydrocarbon feed" may refer to a raw hydrocarbon material which has not been previously treated, separated, or otherwise refined (such as crude oil) or may refer to a hydrocarbon material which has undergone some degree of processing, such as treatment, separation, reaction, purifying, or other operation, prior to being introduced to the hydrocarbon feed conversion system 100 in the hydrocarbon feed stream 102.

TABLE 1

Example of Arab Heavy Export Feedstock

| Analysis | Units | Value |
|---|---|---|
| American Petroleum Institute (API) gravity | degree | 27 |
| Density | grams per cubic centimeter (g/cm$^3$) | 0.8904 |
| Sulfur Content | weight percent (wt. %) | 2.83 |
| Nickel | parts per million by weight (ppmw) | 16.4 |
| Vanadium | ppmw | 56.4 |
| Sodium Chloride (NaCl) Content | ppmw | <5 |
| Conradson Carbon Residue (CCR) | wt. % | 8.2 |
| $C_5$ Asphaltenes | wt. % | 7.8 |
| $C_7$ Asphaltenes | wt. % | 4.2 |

In general, the contents of the hydrocarbon feed stream 102 may include a relatively wide variety of chemical species based on boiling point. For example, the hydrocarbon feed stream 102 may have composition such that the difference between the 5 wt. % boiling point and the 95 wt. % boiling point of the hydrocarbon feed stream 102 is at least 100° C., at least 200° C., at least 300° C., at least 400° C., at least 500° C., or even at least 600° C.

Referring to FIG. 1, the hydrocarbon feed stream 102 may be introduced to the feed separator 104 which may separate the contents of the hydrocarbon feed stream 102 into at least a lesser boiling point fraction stream 106, a medium boiling point fraction stream 107, and a greater boiling point fraction stream 108. In one or more embodiments, at least 90 wt. %, at least 95 wt. %, at least 99 wt. %, or even at least 99.9 wt. % of the hydrocarbon feed stream 102 may be present in the combination of the lesser boiling point fraction stream 106, the medium boiling point fraction stream 107, and the greater boiling point fraction stream 108. In one or more embodiments, the feed separator 104 may be a series of vapor-liquid separators such as a flash drum (sometimes referred to as a breakpot, knock-out drum, knock-out pot, compressor suction drum, or compressor inlet drum). The vapor-liquid separators may be operated at a temperature and pressure suitable to separate the hydrocarbon feed stream 102 into the lesser boiling point fraction stream 106, the medium boiling point fraction stream 107, and the greater boiling point fraction stream 108. It should be understood that a wide variety of fractionating separators may be utilized, such as distillation columns and the like.

In one or more embodiments, the lesser boiling point fraction stream 106 may have a final boiling point of from 280° C. to 320° C., such as from 290° C. to 310° C. In some embodiments, the lesser boiling point fraction stream 106 may generally include naphtha. In some embodiments, the lightest components of the lesser boiling point fraction stream 106 may be those that are liquid at the environmental temperatures (such as the natural temperature at the plant site). In some embodiments, the lightest components of the lesser boiling point fraction stream 106 may be the lightest components of the hydrocarbon feed stream 102. As described herein, the cut points, final boiling points, and initial boiling points are described in atmospheric pressure.

In one or more embodiments, the medium boiling point fraction stream 107 may have a final boiling point of from 520° C. to 560° C., such as from 530° C. to 550° C. The medium boiling point fraction stream 107 may have an initial boiling point of from 280° C. to 320° C., such as from 290° C. to 310° C.

In one or more embodiments, the greater boiling point fraction stream 108 may have an initial boiling point of from 520° C. to 560° C., such as from 530° C. to 550° C. The final boiling point of the greater boiling point fraction stream 108 may generally be dependent upon the heaviest components of the hydrocarbon feed stream 102, and may be, for example, at least 600° C., or even at least 650° C.

In some embodiments, the final boiling point of the lesser boiling point fraction stream 106 may be equal to the initial boiling point of the medium boiling point fraction stream 107. In additional embodiments, the final boiling point of the medium boiling point fraction stream 107 may be equal to the initial boiling point of the greater boiling point fraction stream 108. In such embodiments, a "cut point" (at atmospheric pressure) may be said to exist between the respective fractions. In these embodiments, the cut point between the lesser boiling point fraction stream 106 and the medium boiling point fraction stream 107 may be from 280° C. to 320° C., such as from 290° C. to 310° C. The cut point between the medium boiling point fraction stream 107 and the greater boiling point fraction stream 108 may be from 520° C. to 560° C., such as from 530° C. to 550° C. As described herein, the initial boiling point generally refers to the temperature at which components begin to boil in a hydrocarbon composition, and final boiling point generally refers to the temperature at which all components boil in a hydrocarbon composition.

One or more supplemental feed streams (not shown) may be added to the hydrocarbon feed stream 102 prior to introducing the hydrocarbon feed stream 102 to the feed separator 104. As previously described, in one or more embodiments, the hydrocarbon feed stream 102 may be crude oil. In one or more embodiments, the hydrocarbon feed stream 102 may be crude oil, and one or more supplemental feed streams comprising one or more of a vacuum residue, tar sands, bitumen, atmospheric residue, vacuum gas oils, demetalized oils, naphtha streams, other hydrocarbon streams, or combinations of these materials, may be added to the crude oil upstream of the feed separator 104.

Although some embodiments of the present disclosure focus on converting a hydrocarbon feed stream 102 that is a crude oil, the hydrocarbon feed stream 102 may alternatively comprise a plurality of refinery hydrocarbon streams outputted from one or more crude oil refinery operations. The plurality of refinery hydrocarbon streams may include a vacuum residue, an atmospheric residue, or a vacuum gas oil, for example. In some embodiments, the plurality of refinery hydrocarbon streams may be combined into the hydrocarbon feed stream 102. In these embodiments, the hydrocarbon feed stream 102 may be introduced to the feed separator 104 and separated into the lesser boiling point fraction stream 106, the medium boiling point fraction stream 107, and the greater boiling point fraction stream 108. Alternatively, in some embodiments, the plurality of refinery hydrocarbon streams may be introduced directly to the steam cracking unit 120, the FCC unit 140, and/or the hydroprocessing unit 170. Essentially, in some embodiments, the system 100 may function without feed separator 104 if appropriate streams are supplied as the lesser boiling point fraction stream 106, the medium boiling point fraction stream 107, and the greater boiling point fraction stream 108.

According to one or more embodiments, the lesser boiling point fraction stream 106 may be passed to a stream cracker unit. Now referring to FIG. 2, a steam cracking and separation system is depicted which is representative of the steam cracking unit 120 of FIG. 1. While FIG. 2 represents one embodiments of a steam cracking unit, other configurations of steam cracking units are contemplated. The steam cracker unit 348 may include a convection zone 350 and a pyrolysis zone 351. The lesser boiling point fraction stream 106 may pass into the convection zone 350 along with steam 305. In the convection zone 350, the upgraded oil stream 303 may be pre-heated to a desired temperature, such as from 400° C. to 650° C. The contents of the upgraded oil stream 303 present in the convection zone 350 may then be passed to the pyrolysis zone 351 where it is steam-cracked. The steam-cracked effluent stream 121 may exit the steam cracker unit 348 and optionally be passed through a heat exchanger 308 where process fluid 309, such as water or pyrolysis fuel oil, cools the steam-cracked effluent stream 121. The steam-cracked effluent stream 121 may include a mixture of cracked hydrocarbon-based materials which may be separated into one or more petrochemical products included in one or more system product streams. For example, the steam-cracked effluent stream 121 may include one or more of fuel gas, ethylene, propylene, butadiene, mixed butenes, C5+, benzene, toluene, and/or fuel oil, which may further be mixed with water from the stream cracking.

According to one or more embodiments, the pyrolysis zone 351 may operate at a temperature of from 700° C. to 900° C. The pyrolysis zone 351 may operate with a residence time of from 0.05 seconds to 2 seconds. The mass ratio of steam 305 to lesser boiling point fraction stream 106 may be from about 0.3:1 to about 2:1.

As is depicted in FIG. 1, the medium boiling point fraction stream 107 may be passed from the feed separator 104 to the FCC unit 140. Now referring to FIG. 3, an embodiment of an FCC unit 140 is depicted. It should be understood that other configurations of FCC units are contemplated for use in the system 100. The FCC unit 140 may include a catalyst/feed mixing zone 156, a cracking reaction zone 142, a separation zone 150, and a stripping zone 152. The medium boiling point fraction stream 107 may be introduced to the catalyst/feed mixing zone 156, where the medium boiling point fraction stream 107 may be mixed with the catalyst 144. During steady state operation of the FCC unit 140, the catalyst 144 may include at least the regenerated catalyst 116 that is passed to the catalyst/feed mixing zone 156 from a catalyst hopper 174. In embodiments, the catalyst 144 may be a mixture of spent catalyst 146 and regenerated catalyst 116. The catalyst hopper 174 may receive the regenerated catalyst 116 from the regenerator 160 following regeneration of the spent catalyst 146. At initial start-up of the FCC unit 140, the catalyst 144 may include fresh catalyst (not shown), which is catalyst that has not been circulated through the FCC unit 140 and the regenerator 160. In embodiments, fresh catalyst may also be introduced to catalyst hopper 174 during operation of the hydrocarbon feed conversion system 100 so that at least a portion of the catalyst 144 introduced to the catalyst/feed mixing zone 156 includes the fresh catalyst. Fresh catalyst may be introduced to the catalyst hopper 174 periodically during operation to replenish lost catalyst or compensate for spent catalyst that becomes permanently deactivated, such as through heavy metal accumulation in the catalyst.

The mixture comprising the medium boiling point fraction stream 107 and the catalyst 144 may be passed from the catalyst/feed mixing zone 156 to the cracking reaction zone 142. The mixture of the medium boiling point fraction stream 107 and catalyst 144 may be introduced to a top portion of the cracking reaction zone 142. The cracking reaction zone 142 may be a downflow reactor or "downer" reactor in which the reactants flow from the catalyst/feed mixing zone 156 downward through the cracking reaction zone 142 to the separation zone 150. Steam may be introduced to the top portion of the cracking reaction zone 142 to provide additional heating to the mixture of the medium boiling point fraction stream 107 and the catalyst 144. The medium boiling point fraction stream 107 may be reacted by contact with the catalyst 144 in the cracking reaction zone 142 to cause at least a portion of the medium boiling point fraction stream 107 to undergo at least one cracking reaction to form at least one cracking reaction product, which may include at least one of the petrochemical products previously described. The catalyst 144 may have a temperature equal to or greater than the cracking temperature $T_{142}$ of the cracking reaction zone 142 and may transfer heat to the medium boiling point fraction stream 107 to promote the endothermic cracking reaction.

It should be understood that the cracking reaction zone 142 of the FCC unit 140 depicted in FIG. 3 is a simplified schematic of one particular embodiment of the cracking reaction zone 142, and other configurations of the cracking reaction zone 142 may be suitable for incorporation into the hydrocarbon feed conversion system 100. For example, in some embodiments, the cracking reaction zone 142 may be an up-flow cracking reaction zone. Other cracking reaction zone configurations are contemplated. The FCC unit may be a hydrocarbon feed conversion unit in which in the cracking reaction zone 142, the fluidized catalyst 144 contacts the medium boiling point fraction stream 107 at high-severity conditions. The cracking temperature $T_{142}$ of the cracking reaction zone 142 may be from 500° C. to 800° C., from 500° C. to 700° C., from 500° C. to 650° C., from 500° C. to 600° C., from 550° C. to 800° C., from 550° C. to 700° C., from 550° C. to 650° C., from 550° C. to 600° C., from 600° C. to 800° C., from 600° C. to 700° C., or from 600° C. to 650° C. In some embodiments, the cracking temperature $T_{142}$ of the cracking reaction zone 142 may be from 500° C. to 700° C. In other embodiments, the cracking temperature $T_{142}$ of the cracking reaction zone 142 may be from 550° C. to 630° C. In some embodiments, the cracking temperature $T_{142}$ may be different than the first cracking temperature $T_{122}$.

A weight ratio of the catalyst 144 to the medium boiling point fraction stream 107 in the cracking reaction zone 142 (catalyst to hydrocarbon ratio) may be from 5:1 to 40:1, from 5:1 to 35:1, from 5:1 to 30:1, from 5:1 to 25:1, from 5:1 to 15:1, from 5:1 to 10:1, from 10:1 to 40:1, from 10:1 to 35:1, from 10:1 to 30:1, from 10:1 to 25:1, from 10:1 to 15:1, from 15:1 to 40:1, from 15:1 to 35:1, from 15:1 to 30:1, from 15:1 to 25:1, from 25:1 to 40:1, from 25:1 to 35:1, from 25:1 to 30:1, or from 30:1 to 40:1. The residence time of the mixture of catalyst 144 and the medium boiling point fraction stream 107 in the cracking reaction zone 142 may be from 0.2 seconds (sec) to 3 sec, from 0.2 sec to 2.5 sec, from 0.2 sec to 2 sec, from 0.2 sec to 1.5 sec, from 0.4 sec to 3 sec, from 0.4 sec to 2.5 sec, or from 0.4 sec to 2 sec, from 0.4 sec to 1.5 sec, from 1.5 sec to 3 sec, from 1.5 sec to 2.5 sec, from 1.5 sec to 2 sec, or from 2 sec to 3 sec.

Following the cracking reaction in the cracking reaction zone 142, the contents of effluent from the cracking reaction zone 142 may include catalyst 144 and the cracking reaction product stream 141, which may be passed to the separation zone 150. In the separation zone 150, the catalyst 144 may be separated from at least a portion of the cracking reaction product stream 141. In embodiments, the separation zone 150 may include one or more gas-solid separators, such as one or more cyclones. The catalyst 144 exiting from the separation zone 150 may retain at least a residual portion of the cracking reaction product stream 141.

After the separation zone 150, the catalyst 144 may be passed to the stripping zone 152, where at least some of the residual portion of the cracking reaction product stream 141 may be stripped from the catalyst 144 and recovered as a stripped product stream 154. The stripped product stream 154 may be passed to one or more than one downstream unit operations or combined with one or more than one other streams for further processing. Steam 133 may be introduced to the stripping zone 152 to facilitate stripping the cracking reaction product stream 141 from the catalyst 144. The stripped product stream 154 may include at least a portion of the steam 133 introduced to the stripping zone 152 and may be passed out of the stripping zone 152. The stripped product stream 154 may pass through cyclone separators (not shown) and out of the stripper vessel (not shown). The stripped product stream 154 may be directed to one or more product recovery systems in accordance with known methods in the art, such as recycled by combining with steam 127. The stripped product stream 154 may also be combined with one or more other streams, such as the cracking reaction product stream 141. Combination with other streams is contemplated. For example, the first stripped product stream 134, which may comprise a majority steam, may be combined with steam 127. In another embodiment, the first stripped product stream 134 may be separated into steam and hydrocarbons, and the steam portion may be combined with steam 127. The spent catalyst 146, which is the catalyst 144 after stripping out the stripped product stream 154, may be passed from the stripping zone 152 to the regeneration zone 162 of the regenerator 160.

The catalyst 144 used in the hydrocarbon feed conversion system 100 may include one or more fluid catalytic cracking catalysts that are suitable for use in the cracking reaction zone 142. The catalyst may be a heat carrier and may provide heat transfer to the medium boiling point fraction stream 107 in the cracking reaction zone 142 operated at high-severity conditions. The catalyst may also have a plurality of catalytically active sites, such as acidic sites for example, that promote the cracking reaction. For example, in embodiments, the catalyst may be a high-activity FCC catalyst having high catalytic activity. Examples of fluid catalytic cracking catalysts suitable for use in the hydrocarbon feed conversion system 100 may include, without limitation, zeolites, silica-alumina catalysts, carbon monoxide burning promoter additives, bottoms cracking additives, light olefin-producing additives, other catalyst additives, or combinations of these components. Zeolites that may be used as at least a portion of the catalyst for cracking may include, but are not limited to Y, REY, USY, RE-USY zeolites, or combinations of these. The catalyst may also include a shaped selective catalyst additive, such as ZSM-5 zeolite crystals or other pentasil-type catalyst structures, which are often used in other FCC processes to produce light olefins and/or increase FCC gasoline octane. In one or more embodiments, the catalyst may include a mixture of a ZSM-5 zeolite crystals and the cracking catalyst zeolite and matrix structure of a typical FCC cracking catalyst. In one or more embodiments, the catalyst may be a mixture of Y and ZSM-5 zeolite catalysts embedded with clay, alumina, and binder.

In one or more embodiments, at least a portion of the catalyst may be modified to include one or more rare earth elements (15 elements of the Lanthanide series of the IUPAC Periodic Table plus scandium and yttrium), alkaline earth metals (Group 2 of the IUPAC Periodic Table), transition metals, phosphorus, fluorine, or any combination of these, which may enhance olefin yield in the first cracking reaction zone 122, cracking reaction zone 142, or both. Transition metals may include "an element whose atom has a partially filled d sub-shell, or which can give rise to cations with an incomplete d sub-shell" [IUPAC, Compendium of Chemical Terminology, 2nd ed. (the "Gold Book") (1997). Online corrected version: (2006-) "transition element"]. One or more transition metals or metal oxides may also be impregnated onto the catalyst. Metals or metal oxides may include one or more metals from Groups 6-10 of the IUPAC Periodic Table. In some embodiments, the metals or metal oxides may include one or more of molybdenum, rhenium, tungsten, or any combination of these. In one or more embodiments, a portion of the catalyst may be impregnated with tungsten oxide.

The regenerator 160 may include the regeneration zone 162, a catalyst transfer line 164, the catalyst hopper 174, and a flue gas vent 166. The catalyst transfer line 164 may be fluidly coupled to the regeneration zone 162 and the catalyst hopper 174 for passing the regenerated catalyst 116 from the regeneration zone 162 to the catalyst hopper 174. In some embodiments, the regenerator 160 may have more than one catalyst hopper 174, such as a first catalyst hopper (not shown) for the FCC unit 140, for example. In some embodiments, the flue gas vent 166 may be positioned at the catalyst hopper 174.

In operation, the spent catalyst 146 may be passed from the stripping zone 152 to the regeneration zone 162. Combustion gases may be introduced to the regeneration zone 162. The combustion gases may include one or more of combustion air, oxygen, fuel gas, fuel oil, other components, or any combinations of these. In the regeneration zone 162, the coke deposited on the spent catalyst 146 may at least partially oxidize (combust) in the presence of the combustion gases to form at least carbon dioxide and water. In some embodiments, the coke deposits on the spent catalyst 146 may be fully oxidized in the regeneration zone 162. Other organic compounds, such as residual first cracking reaction product or cracking reaction product for example, may also oxidize in the presence of the combustion gases in the regeneration zone. Other gases, such as carbon monoxide for example, may be formed during coke oxidation in the regeneration zone 162. Oxidation of the coke deposits produces heat, which may be transferred to and retained by the regenerated catalyst 116.

The flue gases 175 may convey the regenerated catalyst 116 through the catalyst transfer line 164 from the regeneration zone 162 to the catalyst hopper 174. The regenerated catalyst 116 may accumulate in the catalyst hopper 174 prior to passing from the catalyst hopper 174 to the FCC unit 140. The catalyst hopper 174 may act as a gas-solid separator to separate the flue gas 172 from the regenerated catalyst 116. In embodiments, the flue gas 175 may pass out of the catalyst hopper 174 through a flue gas vent 166 disposed in the catalyst hopper 174.

The catalyst may be circulated through the FCC unit 140, the regenerator 160, and the catalyst hopper 174. The catalyst 144 may be introduced to the FCC unit 140 to catalytically crack the medium boiling point fraction stream 107 in the FCC unit 140. During cracking, coke deposits may form on the catalyst 144 to produce the spent catalyst 146 passing out of the stripping zone 152. The spent catalyst 146 also may have a catalytic activity that is less than the catalytic activity of the regenerated catalyst 116, meaning that the spent catalyst 146 may be less effective at enabling the cracking reactions compared to the regenerated catalyst 116. The spent catalyst 146 may be separated from the cracking reaction product stream 141 in the separation zone 150 and the stripping zone 152. The spent catalyst 146 may then be regenerated in the regeneration zone 162 to produce the regenerated catalyst 116. The regenerated catalyst 116 may be transferred to the catalyst hopper 174.

The regenerated catalyst 116 passing out of the regeneration zone 162 may have less than 1 wt. % coke deposits, based on the total weight of the regenerated catalyst 116. In some embodiments, the regenerated catalyst 116 passing out of the regeneration zone 162 may have less than 0.5 wt. %, less than 0.1 wt. %, or less than 0.05 wt. % coke deposits. In some embodiments, the regenerated catalyst 116 passing out of the regeneration zone 162 to the catalyst hopper 174 may have from 0.001 wt. % to 1 wt. %, from 0.001 wt. % to 0.5 wt. %, from 0.001 wt. % to 0.1 wt. %, from 0.001 wt. % to 0.05 wt. %, from 0.005 wt. % to 1 wt. %, from 0.005 wt. % to 0.5 wt. %, from 0.005 wt. % to 0.1 wt. %, from 0.005 wt. % to 0.05 wt. %, from 0.01 wt. % to 1 wt. %, from 0.01 wt. % to 0.5 wt. % to 0.01 wt. % to 0.1 wt. %, from 0.01 wt. % to 0.05 wt. % coke deposits, based on the total weight of the regenerated catalyst 116. In one or more embodiments, the regenerated catalyst 116 passing out of regeneration zone 162 may be substantially free of coke deposits. As used in this disclosure, the term "substantially free" of a component means less than 1 wt. % of that component in a particular portion of a catalyst, stream, or reaction zone. As an example, the regenerated catalyst 116 that is substantially free of coke deposits may have less than 1 wt. % of coke deposits. Removal of the coke deposits from the regenerated catalyst 116 in the regeneration zone 162 may remove the coke deposits from the catalytically active sites, such as acidic sites for example, of the catalyst that promote the cracking reaction. Removal of the coke deposits from the catalytically active sites on the catalyst may increase the catalytic activity of the regenerated catalyst 116 compared to the spent catalyst 146. Thus, the regenerated catalyst 116 may have a catalytic activity that is greater than the spent catalyst 146.

The regenerated catalyst 116 may absorb at least a portion of the heat generated from combustion of the coke deposits. The heat may increase the temperature of the regenerated catalyst 116 compared to the temperature of the spent catalyst 146. The regenerated catalyst 116 may accumulate in the catalyst hopper 174 until it is passed back to the FCC unit 140 as at least a portion of the catalyst 144. The regenerated catalyst 116 in the catalyst hopper 174 may have a temperature that is equal to or greater than the cracking temperature $T_{142}$ in the cracking reaction zone 142 of the FCC unit 140. The greater temperature of the regenerated catalyst 116 may provide heat for the endothermic cracking reaction in the cracking reaction zone 142.

According to some embodiments, steam 127 may be mixed with the medium boiling point fraction stream 107 prior to being passed to the FCC unit 140. Steam 127 may be combined with the medium boiling point fraction stream 107 upstream of the cracking of the medium boiling point fraction stream 107. Steam 127 may act as a diluent to reduce a partial pressure of the hydrocarbons in the hydrotreated atmospheric residue stream 108. The steam:oil mass ratio of the combined mixture of steam 127 and medium boiling point fraction stream 107 may be at least 0.5. In additional embodiments, the steam:oil ratio may be from 0.5 to 0.55, from 0.55 to 0.6, from 0.6 to 0.65, from 0.65 to 0.7, from 0.7 to 0.75, from 0.75 to 0.8, from 0.8 to 0.85, from 0.85 to 0.9, from 0.9 to 0.95, or any combination of these ranges.

Steam 127 may serve the purpose of lowering hydrocarbon partial pressure, which may have the dual effects of increasing yields of light olefins (e.g., ethylene, propylene and butylene) as well as reducing coke formation. Light olefins like propylene and butylene are mainly generated from catalytic cracking reactions following the carbonium ion mechanism, and as these are intermediate products, they can undergo secondary reactions such as hydrogen transfer and aromatization (leading to coke formation). Steam 127 may increase the yield of light olefins by suppressing these secondary bi-molecular reactions, and reduce the concentration of reactants and products which favor selectivity towards light olefins. The steam 127 may also suppress secondary reactions that are responsible for coke formation on catalyst surface, which is good for catalysts to maintain high average activation. These factors may show that a large steam-to-oil weight ratio is beneficial to the production of light olefins. However, the steam-to-oil weight ratio may not be enhanced infinitely in the practical industrial operating process, since increasing the amount of steam 127 will result in the increase of the whole energy consumption, the decrease of disposal capacity of unit equipment, and the inconvenience of succeeding condensation and separation of products. Therefore, the optimum steam:oil ratio may be a function of other operating parameters.

In some embodiments, steam 127 may also be used to preheat the hydrotreated atmospheric residue stream 108. Before the hydrotreated atmospheric residue stream 108 enters the FCC unit 140, the temperature of the hydrotreated atmospheric residue stream 108 may be increased by mixing with the steam 127. However, it should be understood that the temperature of the mixed steam and oil streams may be less than or equal to 250° C. Temperatures greater than 250° C. may cause fouling caused by cracking of the hydrotreated atmospheric residue stream 108. Fouling may lead to blockage of the reactor inlet. The reaction temperature (such as greater than 500° C.) may be achieved by using hot catalyst from the regeneration and/or fuel burners. That is, the steam 127 may be insufficient to heat the reactant streams to reaction temperatures, and may be ineffective in increasing the temperature by providing additional heating to the mixture at temperatures present inside of the reactors (e.g., greater than 500° C.). In some embodiments, the steam described herein in steam 127 is not utilized to increase temperature within the reactor, but rather to dilute the oils and reduce oil partial pressure in the reactor. Instead, the mixing of steam and oil may be sufficient to vaporize the oils at a temperature of less than 250° C. to avoid fouling.

The products of the FCC unit 140 in the cracking reaction product stream 141 may comprise fuel gas, LPG, naphtha, distillate, gas oil, and/or slurry. In some embodiments gas oil may be present in the cracking reaction product stream 141 in an amount of at least 30 wt. %.

Now again referring to FIG. 1, the heavy boiling point fraction stream 108 may be passed to the hydrocracking unit 170 where it is contacted by the hydrocracking catalyst. Contact by the hydrocracking catalyst with the heavy boiling point fraction stream 108 may crack carbon-carbon bonds in the contents of the heavy boiling point fraction stream 108 and may, in particular, reduce aromatic content present in the heavy boiling point fraction stream 108. A wide variety of hydrocracking catalysts are contemplated as useful, and the description of some suitable hydrocracking catalysts should be construed as limiting on the presently disclosed embodiments.

The hydrocracking catalyst may comprise one or more metals from IUPAC Groups 5, 6, 8, 9, or 10 of the periodic table. For example, the hydrocracking catalyst may comprise one or more metals from IUPAC Groups 5 or 6, and one or more metals from IUPAC Groups 8, 9, or 10 of the periodic table. For example, the hydrocracking catalyst may comprise molybdenum or tungsten from IUPAC Group 6 and nickel or cobalt from IUPAC Groups 8, 9, or 10. The HDM catalyst may further comprise a support material, and the metal may be disposed on the support material, such as a zeolite. In one embodiment, the hydrocracking catalyst may comprise tungsten and nickel metal catalyst on a zeolite support. In another embodiment, the hydrocracking catalyst may comprise molybdenum and nickel metal catalyst on a zeolite support.

The zeolite support material is not necessarily limited to a particular type of zeolite. However, it is contemplated that zeolites such as Y, Beta, AWLZ-15, LZ-45, Y-82, Y-84, LZ-210, LZ-25, Silicalite, or mordenite may be suitable for use in the presently described hydrocracking catalyst. For example, suitable zeolites which can be impregnated with one or more catalytic metals such as W, Ni, Mo, or combinations thereof, are described in at least U.S. Pat. No.

7,785,563; Zhang et al., Powder Technology 183 (2008) 73-78; Liu et al., Microporous and Mesoporous Materials 181 (2013) 116-122; and Garcia-Martinez et al., Catalysis Science & Technology, 2012 (DOI: 10.1039/c2cy00309k).

In one or more embodiments, the hydrocracking catalyst may comprise from 18 wt. % to 28 wt. % of a sulfide or oxide of tungsten (such as from 20 wt. % to 27 wt. % or from 22 wt. % to 26 wt. % of tungsten or a sulfide or oxide of tungsten), from 2 wt. % to 8 wt. % of an oxide or sulfide of nickel (such as from 3 wt. % to 7 wt. % or from 4 wt. % to 6 wt. % of an oxide or sulfide of nickel), and from 5 wt. % to 40 wt. % of zeolite (such as from 10 wt. % to 35 wt. % or from 10 wt. % to 30 wt. % of zeolite). In another embodiment, the hydrocracking catalyst may comprise from 12 wt. % to 18 wt. % of an oxide or sulfide of molybdenum (such as from 13 wt. % to 17 wt. % or from 14 wt. % to 16 wt. % of an oxide or sulfide of molybdenum), from 2 wt. % to 8 wt. % of an oxide or sulfide of nickel (such as from 3 wt. % to 7 wt. % or from 4 wt. % to 6 wt. % of an oxide or sulfide of nickel), and from 5 wt. % to 40 wt. % of zeolite (such as from 10 wt. % to 35 wt. % or from 10 wt. % to 30 wt. % of zeolite).

The embodiments of the hydrocracking catalysts described may be fabricated by selecting a zeolite and impregnating the zeolite with one or more catalytic metals or by comulling zeolite with other components. For the impregnation method, the zeolite, active alumina (for example, boehmite alumina), and binder (for example, acid peptized alumina) may be mixed. An appropriate amount of water may be added to form a dough that can be extruded using an extruder. The extrudate may be dried at 80° C. to 120° C. for 4 hours to 10 hours, and then calcinated at 500° C. to 550° C. for 4 hours to 6 hours. The calcinated extrudate may be impregnated with an aqueous solution prepared by the compounds comprising Ni, W, Mo, Co, or combinations thereof. Two or more metal catalyst precursors may be utilized when two metal catalysts are desired. However, some embodiments may include only one of Ni, W, Mo, or Co. For example, the catalyst support material may be impregnated by a mixture of nickel nitrate hexahydrate (that is, $Ni(NO_3)_2.6H_2O$) and ammonium metatungstate (that is, $(NH_4)_6H_2W_{12}O_{40}$) if a W—Ni catalyst is desired. The impregnated extrudate may be dried at 80° C. to 120° C. for 4 hours to 10 hours, and then calcinated at 450° C. to 500° C. for 4 hours to 6 hours. For the comulling method, the zeolite may be mixed with alumina, binder, and the compounds comprising W or Mo, Ni or Co (for example $MoO_3$ or nickel nitrate hexahydrate if Mo—Ni is desired).

It should be understood that some embodiments of the presently described methods and systems may utilize a hydrocracking catalyst that includes a mesoporous zeolite (that is, having an average pore size of from 2 nm to 50 nm). However, in other embodiments, the average pore size of the zeolite may be less than 2 nm (that is, microporous).

The products of the heavy boiling point fraction stream 108 may comprise fuel gas, LPG, naphtha (for example, C5 to 430° F. hydrocarbons), LCO (for example, 430° F. to 650° F. hydrocarbons), bottoms (for example, 650° F.+ hydrocarbons, and/or coke). In some embodiments naphtha may be present in the product stream of the heavy boiling point fraction stream 108 in an amount of at least 30 wt. %.

In one or more embodiments, the products of the steam cracking unit 120, the FCC unit 140, and/or the hydrocracking unit 170 may be further separated into system products or recycled within the system 100. It should be understood that, while FIG. 1 depicts various separation apparatuses and recycle streams, products of the steam cracking unit 120, the FCC unit 140, and/or the hydrocracking unit 170 may exit the system 100 as system products in some embodiments. However, herein described are one or more embodiments depicted in FIG. 1 which utilize recycling and separation of the one or more product effluents of the steam cracking unit 120, the FCC unit 140, and/or the hydrocracking unit 170.

In one or more embodiments, and as depicted in FIG. 1, the products of the steam cracking unit 120 may be passed to the product separation unit 180 in a steam-cracked effluent stream 121. In additional embodiments, the products of the FCC unit 140 may be passed to the product separation unit 180 in a catalytically cracked effluent stream 141. The steam-cracked effluent stream 121 and/or the catalytically cracked effluent stream 141 may be separated by product separation unit 180 into system product streams. The product separation unit 180 may be a distillation column or collection of separation devices that separates the steam cracked effluent stream 121, the catalytically cracked effluent stream 141, or both into one or more system product streams. The system product streams passed from the product separation unit 180 may include a hydrogen stream 181, a light olefin stream 182, a Benzene, toluene, and xylene (BTX) stream 183. As presently described, "light olefins" which may exit in a product stream include ethylene, propylene and butylenes. Additionally, fuel oil may be produced and passed via stream 185 as a system product. Additional streams exiting the product separation unit 180 may include naphtha and off gas products.

Several other streams formed by the product separation unit 180 may be recycled in the system 100. For example, C2-C4 alkanes may be passed to the steam cracking unit 120 via stream 186. Additionally, cracked naphtha, light cycle oil, and heavy cycle oil may be passed to the hydrocracking unit 170 via stream 184. In some embodiments, the residual effluent stream 184 may include light cycle oil streams with components having boiling points, for example, from 216-343° C., heavy cycle oil streams with components having boiling points, for example, greater than 343° C. In additional embodiments, stream 186 may be passed from the product separation unit 180 to the steam cracking unit 120. Stream 186 may contain C2-C4 alkanes and methane.

In one or more embodiments, the products of the hydrocracking unit 170 may be passed to one or more of the FCC unit 140 or the steam cracking unit 120. As is depicted in FIG. 1, in some embodiments, a portion of the products of the hydrocracking unit 170 may be passed to the FCC unit 140, and another portion of the products of the hydrocracking unit 170 may be passed to the steam cracking unit 120. In one or more embodiments, the first hydrocracked effluent stream 171 may include C2-C4 alkanes and methane, which may be formed by the hydrocracking unit 170. The second hydrocracked effluent stream 172 may include naphtha and heavier fractions. Generally, the second hydrocracked effluent stream 172 may include all products of the hydrocracking unit 170 which are heavier than butylene.

According to the embodiments presently disclosed, a number of advantages may be present over conventional conversion systems which do not separate the hydrocarbon feed stream into three or more streams prior to introduction into a cracking unit such as a steam cracker unit. That is, conventional cracking units which inject, for example, the entirety of the feedstock hydrocarbon into a steam cracker unit may be deficient in certain respects as compared with the conversions system of FIG. 1. For example, by separating the hydrocarbon feed stream 102 prior to introduction into a steam cracking unit 120, a higher amount of light-fraction system products may be produced. According to the embodiments presently described, by only introducing the lesser boiling point fraction stream 106 to the steam cracking unit 120, the amount of lesser boiling point products such as hydrogen, methane, ethylene, propene, butadiene, and mixed butenes may be increased, while the amount of greater boiling point products such as hydrocarbon oil can be reduced. At the same time, the residue stream 108 may be hydroprocessed in the hydroprocessing unit 170 to produce the second hydrocracked effluent stream 172. The second hydroprocessed effluent stream 172 may be sent to the FCC unit 140. The second hydrocracked effluent stream 172 and the medium boiling point fraction stream 107 can be converted via the FCC unit 140 into other valuable system products such as light cycle oil, naphtha, mixed $C_4$, ethylene and propylene. According to another embodiment, coking in the steam cracking unit 120 may be reduced by the elimination of materials present in the greater boiling point fraction stream 107. Without being bound by theory, it is believed that injecting highly aromatic feeds into a steam cracker unit may result in greater boiling point products and increased coking. Thus, it is believed that coking can be reduced and greater quantities of lesser boiling point products can be produced by the steam cracking unit 120 when highly-aromatic materials are not introduced to the steam cracking unit 120 and are instead separated into at least a portion of the greater boiling point fraction stream 107 by the feed separator 110.

According to another embodiment, capital costs may be reduced by the designs of the hydrocarbon feed conversion system 100 of FIG. 1. Since the hydrocarbon feed stream 102 is fractionated by the feed separator 104, not all of the cracking furnaces of the system need to be designed to handle the materials contained in the medium boiling point fraction stream 107 and the greater boiling point fraction stream 108. It is expected that system components designed to treat lesser boiling point materials such as those contained in the lesser boiling point fraction stream 106 would be less expensive than system components designed to treat greater boiling point materials, such as those contained in the medium boiling point fraction stream 107 and the greater boiling point fraction stream 108. For example, the convection zone of the steam cracking unit 120 can be designed simpler and cheaper than an equivalent convection zone that is designed to process the materials of the medium boiling point fraction stream 107 and the greater boiling point fraction stream 108.

According to another embodiment, system components such as vapor-solid separation devices and vapor-liquid separation devices may not need to be utilized between the convection zone and the pyrolysis zone of the steam cracking unit 120. In some conventional steam cracker units, a vapor-liquid separation device may be required to be positioned between the convection zone and the pyrolysis zone. This vapor-liquid separation device may be used to remove the greater boiling point components present in a convection zone, such as any vacuum residues. However, in some embodiments of the hydrocarbon feed conversion system 100 of FIG. 2, a vapor-liquid separation device may not be needed, or may be less complex since it does not encounter greater boiling point materials such as those present in the medium boiling point fraction stream 107 and the greater boiling point fraction stream 108. Additionally, in some embodiments described, the steam cracking unit 120 may be able to be operated more frequently (that is, without intermittent shut-downs) caused by the processing of relatively heavy feeds. This higher frequency of operation may sometimes be referred to as increased on-stream-factor.

EXAMPLES

The various embodiments of methods and systems for the conversion of a feedstock fuels will be further clarified by the following examples. The examples are illustrative in nature, and should not be understood to limit the subject matter of the present disclosure.

Example A

Example A provides an example of a process in which Arab Extra Light Crude Oil (available from Saudi Aramco) is separated into three fractions with cut points at 300° C. and 540° C. Each fraction was modeled in Aspen HYSYS according to embodiments of the present disclosure, utilizing a steam cracker, a fluidized catalytic cracker, and a hydrocracker. Table 3 shows the product yields in the feed separation unit. The data of Example A is directed to an embodiment of that of FIG. 1, as described herein. Tables 3A and 3B show a mass balance of Example A line numbers corresponding to FIG. 1. Table 3C shows the percentages of the feed separated into each of the streams 106, 107, and 108.

TABLE 3A

| Mass Balance | | | | | | | | |
|---|---|---|---|---|---|---|---|---|
| Line Number | 102 | 106 | 107 | 108 | 121 | 141 | 171 | 172 |
| Molar Flow [kgmole/h] | 1513 | 1264 | 218 | 30 | 2794 | 3339 | 360 | 558 |
| Mass Flow [kg/h] | 272158 | 174204 | 75414 | 22540 | 183424 | 165797 | 11139 | 87311 |

TABLE 3B

| Mass Balance | | | | | | | | |
|---|---|---|---|---|---|---|---|---|
| Line Number | 181 | 182 | 183 | 184 | 185 | 186 | 187 | 188 |
| Molar Flow [kgmole/h] | 339 | 2975 | 71 | 449 | 1 | 1037 | 478 | 708 |
| Mass Flow [kg/h] | 684 | 115949 | 5959 | 98513 | 884 | 24406 | 11245 | 95032 |

TABLE 3C

| Product yields in the feed separation unit | |
|---|---|
| Component | Wt. % |
| Greater BP fraction | 64.0 |
| Medium BP fraction | 27.7 |
| Greater BP fraction | 8.3 |

Table 4 shows the product yields for the lesser boiling point fraction stream cracked in the steam cracker unit. The temperature was 850° C. at atmospheric pressure. No catalyst was used in steam cracking.

Table 5 shows the product yields for the medium boiling point fraction stream cracked in the FCC unit. Table 5 includes reaction conditions. The modeling used 600° C. and a catalyst to oil ratio of 15.

Table 6 shows the product yields for the greater boiling point fraction cracked in the hydroprocessing unit. The temperature for modeling was 371° C. at 130 bar pressure. The standard hydroprocessing catalyst utilized in Aspen HYSYS was used for modeling. The feed used in this table also includes the recycle streams from the FCC unit.

TABLE 4

Product yields for the lesser boiling point fraction stream cracked in the steam cracker unit, in wt. %

| Component | Feed with recycle (186) | Product |
|---|---|---|
| FG | 2.6 | 7.1 |
| Ethylene | 0.0 | 13.5 |
| Propylene | 0.0 | 5.5 |
| Butadiene | 0.0 | 1.6 |
| LPG | 5.7 | 0.0 |
| C5+ | 59.2 | 35.6 |
| Benzene | 0.0 | 2.1 |
| Toluene | 0.0 | 0.8 |
| Xylenes | 0.0 | 0.3 |
| Fuel Oil | 32.5 | 33.5 |

TABLE 5

Product yields for the greater boiling point fraction stream and 88.7 wt. % of the hydroprocessed stream cracked in the FCC unit.

| Wt. % | Feed | Product |
|---|---|---|
| H2S | 0.0 | 0.6 |
| Fuel Gas | 0.0 | 14.7 |
| Propane | 0.0 | 3.4 |
| Propylene | 0.0 | 24.4 |
| nButane | 0.0 | 1.2 |
| iButane | 0.0 | 2.4 |
| Butenes | 0.0 | 18.3 |
| Naphtha C5-430 F. | 26.4 | 19.6 |
| LCO 430-650 F. | 27.8 | 11.1 |
| Bottoms 650 F.+ | 45.9 | 2.6 |
| Coke Yield | — | 1.8 |

TABLE 6

Product yields for the residue stream cracked in the hydroprocessing unit.

| wt % | Inlet | Outlet |
|---|---|---|
| NH3 | 0.0 | 0.0 |
| H2S | 0.0 | 1.3 |
| C1 + C2 | 0.0 | 3.8 |
| C3 | 0.0 | 1.3 |
| C4 | 0.0 | 3.6 |
| C5 | 0.0 | 1.5 |
| Naphtha C6-430 F. | 10.8 | 43.3 |
| Distillate 430-700 F. | 62.7 | 25.8 |
| Gas Oil 700-1000 F. | 3.4 | 15.6 |
| Resid 1000 F.+ | 23.2 | 3.7 |

Example B

Example B shows an experimental result of cracking AXL 300° C.+ fraction in a fluid bed reactor at 600° C. and catalyst to oil ratio of 12. Catalyst used was 75 wt. % USY catalyst and 25 wt. % ZSM-5 additives. Light olefin yields are reduced by not recycling the majority of a hydrotreated heavy cut to the fluid bed reactor.

TABLE 7

FCC yields for AXL 300° C.+

| Product | Yield |
|---|---|
| Fuel Gas | 15.3 |
| Propane | 3.2 |
| Propylene | 18.3 |
| nButane | 1.3 |
| iButane | 3.8 |
| Butenes | 13.4 |
| C5+ | 39.9 |
| Coke Yield | 4.8 |
| Total | 100.000 |

Example C

Example C is identical to Example A but utilizes Arab heavy crude oil as a feedstock stream. Table 8 shows products by weight percent.

TABLE 8

Product yields when using Arab heavy crude

| Component | wt % |
|---|---|
| Naphtha | 35.0 |
| Distillate | 33.8 |
| Residue | 31.2 |

Example D

Example D is identical to Example A, but does not include recycle of stream 186 into the steam cracker. Table 9 shows product stream data for Example D. Essentially, Table 9 shows steam cracking of only 300° C. or less cut of AXL.

| Component | Feed without recycle | Product |
|---|---|---|
| FG | 0.0 | 5.7 |
| Ethylene | 0.0 | 10.3 |
| Propylene | 0.0 | 4.9 |
| Butadiene | 0.0 | 1.5 |
| LPG | 0.0 | 0.0 |
| C5+ | 64.3 | 38.0 |
| Benzene | 0.0 | 2.1 |
| Toluene | 0.0 | 0.9 |
| Xylenes | 0.0 | 0.3 |
| Fuel Oil | 35.7 | 36.4 |
| Total | 100 | 100 |

For the purposes of defining the present technology, the transitional phrase "consisting of" may be introduced in the claims as a closed preamble term limiting the scope of the claims to the recited components or steps and any naturally occurring impurities.

For the purposes of defining the present technology, the transitional phrase "consisting essentially of" may be introduced in the claims to limit the scope of one or more claims to the recited elements, components, materials, or method steps as well as any non-recited elements, components, materials, or method steps that do not materially affect the novel characteristics of the claimed subject matter.

The transitional phrases "consisting of and" consisting essentially of may be interpreted to be subsets of the open-ended transitional phrases, such as "comprising" and "including," such that any use of an open ended phrase to introduce a recitation of a series of elements, components, materials, or steps should be interpreted to also disclose recitation of the series of elements, components, materials, or steps using the closed terms "consisting of" and "consisting essentially of." For example, the recitation of a composition "comprising" components A, B and C should be interpreted as also disclosing a composition "consisting of" components A, B, and C as well as a composition "consisting essentially of" components A, B, and C.

Any quantitative value expressed in the present application may be considered to include open-ended embodiments consistent with the transitional phrases "comprising" or "including" as well as closed or partially closed embodiments consistent with the transitional phrases "consisting of" and "consisting essentially of."

It should be understood that any two quantitative values assigned to a property may constitute a range of that property, and all combinations of ranges formed from all stated quantitative values of a given property are contemplated in this disclosure. It should be appreciated that compositional ranges of a chemical constituent in a stream or in a reactor should be appreciated as containing, in some embodiments, a mixture of isomers of that constituent. For example, a compositional range specifying butene may include a mixture of various isomers of butene. It should be appreciated that the examples supply compositional ranges for various streams, and that the total amount of isomers of a particular chemical composition can constitute a range.

In a first aspect of the present disclosure, hydrocarbon material may be processed by a method that may comprise: separating the hydrocarbon material into at least a lesser boiling point fraction, a medium boiling point fraction, and a greater boiling point fraction; steam cracking at least a portion of the lesser boiling point fraction; catalytically cracking at least a portion of the medium boiling point fraction; and hydrocracking at least a portion of the greater boiling point fraction.

A second aspect of the present disclosure may include the first aspect where the lesser boiling point fraction may have a final boiling point of from 280° C. to 320° C.

A third aspect of the present disclosure may include either of the first or second aspects where the medium boiling point fraction may have an initial boiling point of from 280° C. to 320° C. and may have a final boiling point of from 520° C. to 560° C.

A fourth aspect of the present disclosure may include any of the first through third aspects where the greater boiling point fraction has an initial boiling point of from 520° C. to 560° C.

A fifth aspect of the present disclosure may include any of the first through fourth aspects where the hydrocarbon material is a crude oil.

A sixth aspect of the present disclosure may include any of the first through fifth aspects where at least 90 wt. % of the hydrocarbon material may be present in the combination of the lesser boiling point fraction, the medium boiling point fraction, and the greater boiling point fraction.

A seventh aspect of the present disclosure may include any of the first through sixth aspects where the hydrocarbon material may have composition such that the difference between the 5 wt. % boiling point and the 95 wt. % boiling point of the hydrocarbon material may be at least 100° C.

An eighth aspect of the present disclosure may include any of the first through seventh aspects where the final boiling point of the lesser boiling point fraction may be equal to the initial boiling point of the medium boiling point fraction, and the final boiling point of the medium boiling point fraction may be equal to the initial boiling point of the greater boiling point fraction.

A ninth aspect of the present disclosure may include any of the first through eighth aspects where the FCC unit operates at a temperature of from 500° C. to 800° C.

A tenth aspect of the present disclosure may include any of the first through ninth aspects where the medium boiling point fraction is catalytically cracked in the presence of steam.

An eleventh aspect of the present disclosure may include any of the first through tenth aspects where the mass ratio of steam to medium boiling point fraction may be at least 0.5.

In a twelfth aspect of the present disclosure, hydrocarbon material may be processed by a method that may comprise: separating the hydrocarbon material into at least a lesser boiling point fraction, a medium boiling point fraction, and a greater boiling point fraction; steam cracking at least a portion of the lesser boiling point fraction; catalytically cracking at least a portion of the medium boiling point fraction; and hydrocracking at least a portion of the greater boiling point fraction. The lesser boiling point fraction may have a final boiling point of from 280° C. to 320° C. The medium boiling point fraction may have an initial boiling point of from 280° C. to 320° C. and may have a final boiling point of from 520° C. to 560° C. The greater boiling point fraction may have an initial boiling point of from 520° C. to 560° C.

A thirteenth aspect of the present disclosure may include the twelfth aspect where the hydrocarbon material may be a crude oil.

A fourteenth aspect of the present disclosure may include either of the twelfth or thirteenth aspects where at least 90 wt. % of the hydrocarbon material may be present in the combination of the lesser boiling point fraction, the medium boiling point fraction, and the greater boiling point fraction.

A fifteenth aspect of the present disclosure may include any of the twelfth through fourteenth aspects where the hydrocarbon material may have composition such that the difference between the 5 wt. % boiling point and the 95 wt. % boiling point of the hydrocarbon material may be at least 100° C.

A sixteenth aspect of the present disclosure may include any of the twelfth through fifteenth aspects where the final boiling point of the lesser boiling point fraction may be equal to the initial boiling point of the medium boiling point fraction, and the final boiling point of the medium boiling point fraction may be equal to the initial boiling point of the greater boiling point fraction.

A seventeenth aspect of the present disclosure may include any of the twelfth through sixteenth aspects where the FCC unit may operate at a temperature of from 500° C. to 800° C.

An eighteenth aspect of the present disclosure may include any of the twelfth through seventeenth aspects where the medium boiling point fraction is catalytically cracked in the presence of steam.

A nineteenth aspect of the present disclosure may include any of the twelfth through eighteenth aspects where the mass ratio of steam to medium boiling point fraction may be at least 0.5.

The subject matter of the present disclosure has been described in detail and by reference to specific embodiments. It should be understood that any detailed description of a component or feature of an embodiment does not necessarily imply that the component or feature is essential to the particular embodiment or to any other embodiment. Further, it should be apparent to those skilled in the art that various modifications and variations can be made to the described embodiments without departing from the spirit and scope of the claimed subject matter.

What is claimed is:

1. A method for processing hydrocarbon material, the method comprising:

separating the hydrocarbon material into at least a lesser boiling point fraction, a medium boiling point fraction, and a greater boiling point fraction, wherein a cut point between the lesser boiling point fraction and the medium boiling point fraction is from 280° C. to 320° C., and wherein a cut point between the medium boiling point fraction and the greater boiling point fraction is from 520° C. to 560° C.;

steam cracking at least a portion of the lesser boiling point fraction;

catalytically cracking at least a portion of the medium boiling point fraction; and hydrocracking at least a portion of the greater boiling point fraction.

2. The method of claim 1, wherein the lesser boiling point fraction has a final boiling point of from 280° C. to 320° C.

3. The method of claim 1, wherein the medium boiling point fraction has an initial boiling point of from 280° C. to 320° C. and has a final boiling point of from 520° C. to 560° C.

4. The method of claim 1, wherein the greater boiling point fraction has an initial boiling point of from 520° C. to 560° C.

5. The method of claim 1, wherein the hydrocarbon material is a crude oil.

6. The process of claim 1, wherein at least 90 wt. % of the hydrocarbon material is present in the combination of the lesser boiling point fraction, the medium boiling point fraction, and the greater boiling point fraction.

7. The method of claim 1, wherein the hydrocarbon material has a composition such that the difference between the 5 wt. % boiling point and the 95 wt. % boiling point of the hydrocarbon material is at least 100° C.

8. The method of claim 1, wherein the final boiling point of the lesser boiling point fraction is equal to the initial boiling point of the medium boiling point fraction, and the final boiling point of the medium boiling point fraction is equal to the initial boiling point of the greater boiling point fraction.

9. The method of claim 1, wherein the medium boiling point fraction is catalytically cracked at a temperature of from 500° C. to 800° C.

10. The method of claim 1, wherein the medium boiling point fraction is catalytically cracked in the presence of steam.

11. The method of claim 10, wherein a mass ratio of steam to medium boiling point fraction is at least 0.5.

12. A method for processing hydrocarbon material, the method comprising:

separating the hydrocarbon material into at least a lesser boiling point fraction, a medium boiling point fraction, and a greater boiling point fraction, wherein the lesser boiling point fraction has a final boiling point of from 280° C. to 320° C., wherein the medium boiling point fraction has an initial boiling point of from 280° C. to 320° C. and has a final boiling point of from 520° C. to 560° C., wherein the greater boiling point fraction has an initial boiling point of from 520° C. to 560° C., wherein a cut point between the lesser boiling point fraction and the medium boiling point fraction is from 280° C. to 320° C., and wherein a cut point between the medium boiling point fraction and the greater boiling point fraction is from 520° C. to 560° C.;

steam cracking at least a portion of the lesser boiling point fraction;

catalytically cracking at least a portion of the medium boiling point fraction; and hydrocracking at least a portion of the greater boiling point fraction.

13. The method of claim 12, wherein the hydrocarbon material is a crude oil.

14. The process of claim 12, wherein at least 90 wt. % of the hydrocarbon material is present in the combination of the lesser boiling point fraction, the medium boiling point fraction, and the greater boiling point fraction.

15. The method of claim 12, wherein the hydrocarbon material has composition such that the difference between the 5 wt. % boiling point and the 95 wt. % boiling point of the hydrocarbon material is at least 100° C.

16. The method of claim 12, wherein the final boiling point of the lesser boiling point fraction is equal to the initial boiling point of the medium boiling point fraction, and the final boiling point of the medium boiling point fraction is equal to the initial boiling point of the greater boiling point fraction.

17. The method of claim 12, wherein the medium boiling point fraction is catalytically cracked at a temperature of from 500° C. to 800° C.

18. The method of claim 12, wherein the medium boiling point fraction is catalytically cracked in the presence of steam.

19. The method of claim 18, wherein a mass ratio of steam to medium boiling point fraction is at least 0.5.

* * * * *